United States Patent [19]

Zuev et al.

[11] 4,110,894

[45] Sep. 5, 1978

[54] METHOD AND APPARATUS FOR PRODUCING A CONDUIT INTENDED FOR COMMUNICATION WITH A PLURALITY OF WORKING-MEDIUM SOURCES

[76] Inventors: Alexandr Borisovich Zuev, ulitsa Chervyakova, 6, kv. 121; David Samuilovich Miller, ulitsa Budennogo, 30, kv. 30, both of Minsk, U.S.S.R.

[21] Appl. No.: 782,099

[22] Filed: Mar. 28, 1977

[51] Int. Cl.[2] ..... B22D 19/04

[52] U.S. Cl. ..... 29/527.6; 164/103; 164/111; 164/112

[58] Field of Search ..... 29/527.6; 164/111, 103, 164/112, 98, 100

[56] References Cited

U.S. PATENT DOCUMENTS

| | | | |
|---|---|---|---|
| 138,176 | 4/1873 | Miller | 164/103 |
| 3,118,225 | 1/1964 | McAndrews | 164/112 UX |
| 3,439,732 | 4/1969 | Andreoli | 164/112 |
| 3,461,945 | 8/1969 | Trimble et al. | 164/112 |
| 3,888,295 | 6/1975 | Schillinger | 164/112 X |

FOREIGN PATENT DOCUMENTS

| | | | |
|---|---|---|---|
| 879,287 | 10/1961 | United Kingdom | 164/112 |

*Primary Examiner*—Milton S. Mehr
*Attorney, Agent, or Firm*—Lackenbach, Lilling & Siegel

[57] ABSTRACT

A method and apparatus for producing a conduit intended for communication with a plurality of working-medium sources, which conduit includes at least two connecting elements spaced apart along the length of the conduit and secured thereto. Each connecting element has a through passage communicating with the passage of the conduit and intended for connection with a source of a working-medium. The axis of the through passage is perpendicular to a plane passing through the conduit axis. To make such a conduit, a continuous-surface conduit is fed under pressure to a die-casting machine and is placed in its casting die. The shape of the casting die corresponds to that of connecting elements, in such a way that the axis of a core forming the through passage of each connecting element in the casting die is offset with respect to the conduit's axis with a distance therebetween being sufficient to obtain a strong and tight coupling of the connecting element with the conduit and access is provided for a working tool adapted to make a duct communicating or connecting the through passage with the conduit from the side of the former. Thereafter, the connecting elements are formed by a known method, and the coupling of the conduit with the connecting elements is obtained by means of a pressing force arising on the external surface of the conduit during the period of crystallization of the connecting element's material. A duct for communication or connection of the through passage in the connecting element with the conduit passage is then made by a known method.

The conduits produced by the method of the invention are successfully used in diesel engines.

8 Claims, 6 Drawing Figures

METHOD AND APPARATUS FOR PRODUCING A CONDUIT INTENDED FOR COMMUNICATION WITH A PLURALITY OF WORKING-MEDIUM SOURCES

The present invention relates to mechanical engineering and, more particularly, to a method and apparatus for producing a conduit intended for communication with a plurality of working-medium sources.

The conduits produced by the method according to the invention are successfully used, for instance, in diesel engines.

It is known that in order to ensure normal operation of fuel nozzles in diesel engines, the excess fuel is usually drawn away therefrom by means of a suitable conduit which is connected to the nozzles through connecting elements.

Tight coupling of said connecting elements with the conduit in diesel engines has proved necessary for the whole period of an engine's service life.

During operation of an internal-combustion engine there occurs transformation of translational or reciprocating motion into rotary motion which produces vibration forces acting upon all parts of the engine, including conduits.

Alternating vibration forces and/or loads affect the tightness of coupling of the conduit with the connecting elements, which results in fuel leakages and, thus, in inflammation and/or fire hazards.

The production of known conduits with connecting elements is rather labor-consuming since said elements need to be made separately, then assembled with the conduits, and then their joints must be welded.

Apart from being time-consuming, said process of producing conduits with connecting elements can have harmful effects on the health of the operator because of the welding and soldering processes involved therein.

Known in the prior art is a method of producing a conduit intended for use in piston internal-combustion engines.

Connecting elements having a through passage for bringing the conduit passage into communication with the sources of a working medium are welded to the conduit, each connecting element, in turn, being furnished with flanges previously welded thereto, which flanges have holes for receiving bolts for securing said elements to the body, thus providing for communication of the conduit passage with the working medium sources by means of through passages in the connecting elements.

The described conduits are quite labor-consuming in production. Besides, securing connecting elements by welding provides no reliable coupling since changes arise in material structure in the weld area. Dissimilar structure of material in the weld area of the components welded, which are subject to vibration forces, leads to the occurrence of cracks and to deterioration in tightness. The process of welding is harmful to the operators involved in the making of the aforementioned components.

There is also known another method of producing a conduit for the removal of the excess fuel from fuel nozzles of internal-combustion engines.

Separate conduits are welded to the connecting elements having through passages. The passage of each connecting element communicates with the conduit passage by means of ducts. The through passage axis is perpendicular to the axis of these ducts. The through passage is used to receive a hollow bolt having axial and radial ducts, which bolt secures the conduit to the nozzle body and brings the nozzle chamber into communication with the conduit passage.

Before the ends of the conduits are welded to the connecting elements the latter are machined (ground) to a high surface finish on the surfaces intended to receive seals.

Although these conduits are compact, they are very labor-consuming in making separate components, and also in their assembly and welding.

Inasmuch as the described conduits are used in internal-combustion engines, they are subject to the action of alternating vibration loads. The latter give rise to cracks in the weld area because local structural changes in materials of the connecting element and the conduit (different hardness) arise in the area in the course of welding.

Occurence and development of cracks at the location of coupling between the conduits and the connecting elements leads to the deterioration in tightness and, as a result, to fuel leakages. Any fuel bleeding through a crack and migrating to the heated parts of the engine quickly evaporates. This is inadmissible since the presence of early inflammable fractions of fuel on heated parts of the engine may result in a fire or other hazard.

An object of the present invention is to provide an efficient method of producing conduits used for communication with a plurality of working-medium sources, which allows mass production of such conduits at minimum labor costs.

Another object of the present invention is to provide a reliable construction of a conduit intended for communication with a plurality of working-medium sources.

These and other objects are accomplished by providing a method and apparatus for producing a conduit intended for communication with a plurality of working-medium sources, which conduit includes at least two connecting elements spaced apart along the length thereof and rigidly secured thereto. Each connecting element has a through passage communicating with the passage of the conduit and intended for connection with one working-medium source. The axis of this passage being perpendicular to a plane passing through the conduit axis, and this through passage communicating with the passage of the conduit. Said method of the invention comprising the steps of using a continuous-surface conduit, placing this conduit on a known die-casting machine provided with a device for feeding the conduit into a casting die whose shape corresponds to that of the connecting elements, aligning said conduit in the casting die in such a way that the axis of a core shaping the through passage of each connecting element in the casting die is set off with respect to the conduit axis at a distance sufficient for obtaining a strong and tight coupling of the connecting element with the conduit, forming the connecting elements by a known method, obtaining the coupling of the conduit with the connecting elements by means of a pressing force arising on the external surface of the conduit during the period of crystallization of the connecting elements' material, and making a duct for communication between the through passage in the connecting element and the conduit by a known method.

The method according to the invention allows the mass production of conduits used for communication with a plurality of working-medium sources at minimum labor costs.

The conduit with connecting elements, obtained by this method, has proved to be reliable in use with internal-combustion engines under vibration loads.

Moreover, this method eliminates welding which is harmful for operators.

It is desirable that prior to placing said conduit into the casting die of the die casting machine, knurling be formed at the specified locations of coupling of the conduit with the connecting elements so as to improve the engagement conditions between these components.

Also, it is advisable that prior to placing said conduit into the casting die of the die-casting machine, the specified locations of coupling of the conduit with the connecting elements be heated for improving the engagement conditions between said components.

The appartus of the invention comprises a device for feeding conduits into the cavity of a casting die, which device includes a housing with a storage for the conduits and said storage communicates with an inclined slot whose longitudinal axis is perpendicular to the axis of a conduit and at whose outlet a splitter is disposed. In addition, vertical reciprocating motion for the housing is provided, and the housing is furnished with knurling mechanisms made in the form of knurling dies secured in the housing and knurling rolls rotatable about an axis parallel to the longutidinal axis of the conduit. The knurling dies and rolls facing each other with their knurl-shaping surfaces, and a heater is disposed at the inlet to the cavity of the casting die, the knurling mechanisms and the heater being arranged in succession along the path of the conduits' motion, and the number of the knurling means and the heaters corresponding to the specified number of locations of coupling between the conduit and the connecting elements.

The device and/or apparatus of the invention provides for combined operations of shaping knurls and heating the locations of coupling between the conduit and the connecting elements, which results in considerably reduced time for the preparatory stages in mass production of conduits with connecting elements.

According to the present invention, a construction of a conduit with connecting elements is obtained where the conduit axis is set off with respect to the through passage in each connecting element a distance "A" exceeding the radius "R" of said through passage.

This arrangement of the through passage axis relative to the conduit axis makes for better performance of the conduit because here a larger surface of contact is provided between the conduit and the connecting elements, and conditions are created for a channel to be formed communicating the through passage with the conduit from the side of the former. The enlargement of the contact surface provides a tight coupling between said components working under vibration load arising during the operation of an engine.

Other objects and advantages will be more apparent from the following description of an exemplary embodiment of the invention and the accompanying drawings in which.

Figure 1:
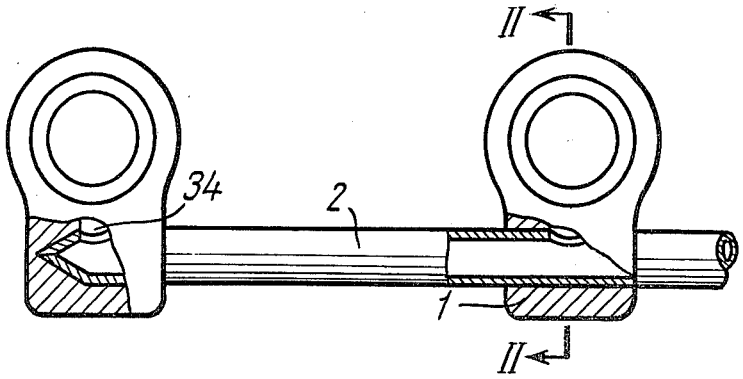
FIG. 1 shows a conduit with connecting elements, according to the invention.

Referring now to the drawings, and to FIG. 1 in particular, there is shown therein a conduit for communication with a plurality of working-medium sources, e.g. a conduit serving to lead off the fuel excess from fuel nozzles of a diesel engine and having at least two connecting elements 1, which are spaced apart along the length of the conduit 2 and rigidly secured thereto.

Figure 2:
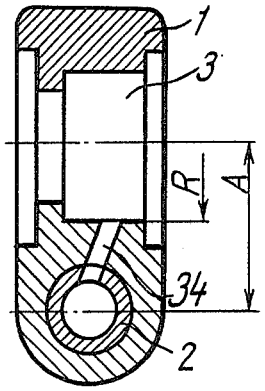
FIG. 2 is a sectional view taken along the line II—II of FIG. 1 and illustrated on an enlarged scale.
Figure 3:
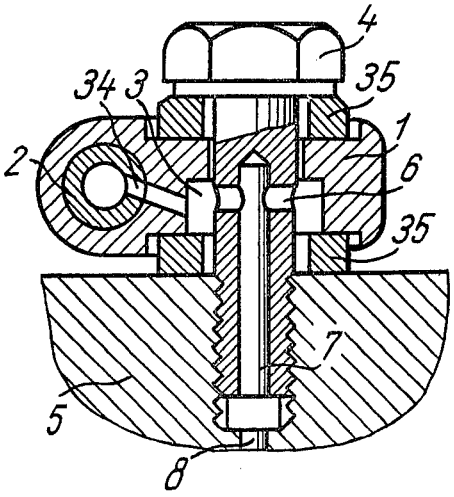
FIG. 3 shows a side elevational view, partly in section, of the conduit with a connecting element made in accordance with the invention and secured to a fuel nozzle of an engine.

Each connecting element 1 has a through passage 3 such as shown in FIG. 2, communicating with the passage of the conduit 2 (see FIGS. 1,2), the axis of the through passage 3 being perpendicular to a plane passing through the axis of the conduit 2. In addition, said through passage 3 is intended for receiving a hollow bolt 4 (FIG. 3) providing for the connection of the conduit 2 with a fuel nozzle 5 of the engine by means of the connecting element 1. The bolt 4 has radial ducts 6 communicating with an axial duct 7 which, in turn, communicates with the duct 8 of the nozzle 5.

Radial ducts 6 are in communication with the through passage 3.

The above conduit 2 (FIG. 1) with the connecting elements 1, according to the invention, is produced with the use of a diecasting machine, known per se, provided with a device for feeding the conduits.

Figure 4:
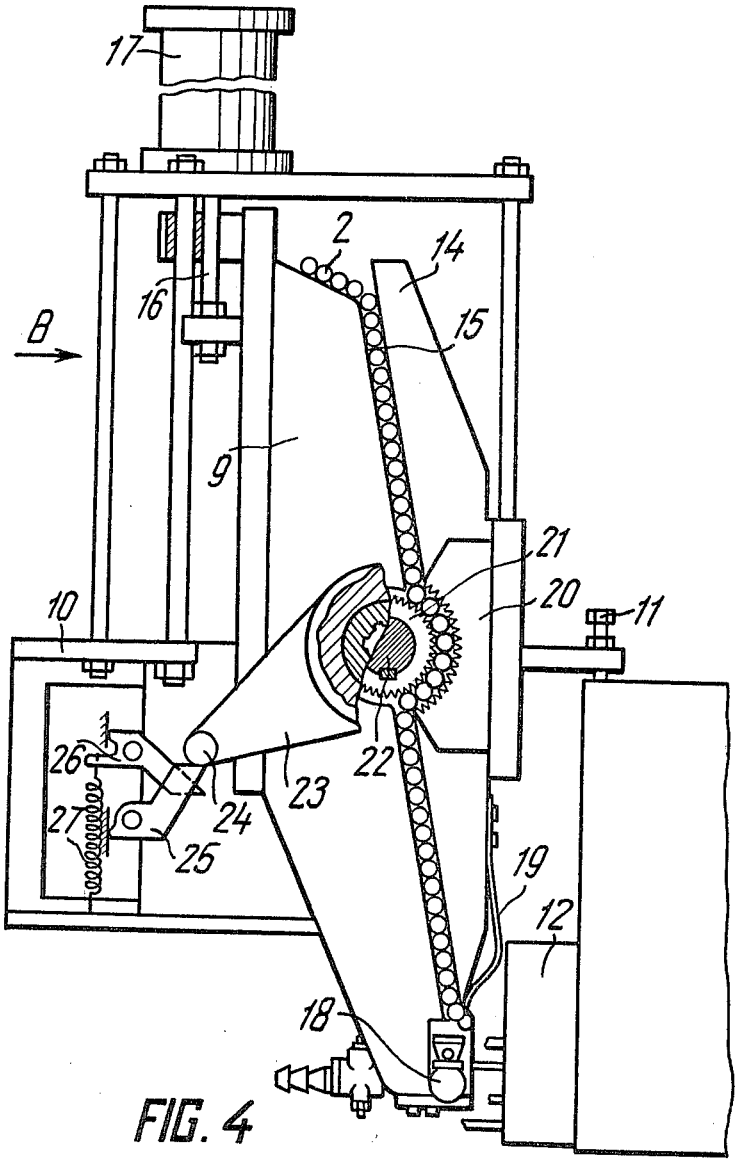
FIG. 4 shows diagrammatically the device for feeding conduits into the cavity of the casting die with a partial scrap end view of a knurling means.
Figure 5:
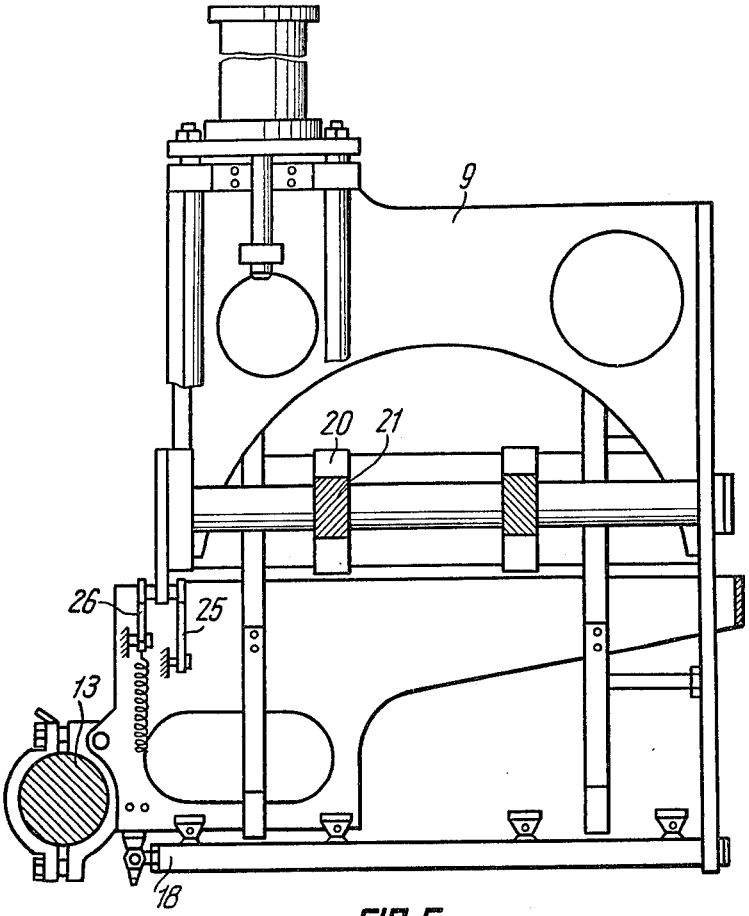
FIG. 5 is a side elevational view in the direction of the arrow B of FIG. 4.

The apparatus of the invention which comprises a device for feeding the conduits into the cavity of the casting die has a housing 9 (FIG. 4). The housing 9 is mounted on a frame 10, fixed to a casting die 12 by means of screws 11, in such a way that it can be pivoted on the bar 13 (FIG. 5) of the die-casting machine. The housing 9 is furnished with a storage 14 (FIG. 4) for conduits 2, which is connected through an inclined slot 15 to the cavity of the casting die 12. The longitudinal axis of the slot 15 is perpendicular to that of the conduit 2. To impart vertical reciprocating motion to the housing 9, there is provided a power cylinder 17 whose piston rod 16 is rigidly linked with said housing. In addition, the housing 9 is provided with a burner 18 serving for heating the conduits 2 and disposed at the lower level of the inclined slot 15, with a splitter 19 spring-loaded with respect to the housing 9, and with a knurling means which is made in the form of a knurling die 20, secured in the housing 9, and a knurling roll 21, these die and roll knurling means defining the middle part of the slot 15. The die 20 and the roll 21 face each other with their surfaces intended to shape knurls on the conduit 2. The knurling means and the burners 18 (heaters) are arranged in succession along the path of motion of the conduits 2. The number of the knurling means and the burners 18 (heaters) corresponds to the specified number of locations on the conduit for its coupling with the connecting elements (FIG. 5). The knurling roll 21 is mounted on an axle 22 (FIG. 4) which is parallel to the axis of the conduits 2. The axle 22 defines the axis of rotation for an overrunning clutch 23 whose cams 24 interact with levers 25 and 26 pivotally mounted on the frame 10 and serving for setting and return of the overrunning clutch 23. One of the levers

(26) is spring-loaded by a spring 27 anchored to the frame 10.

Figure 6:
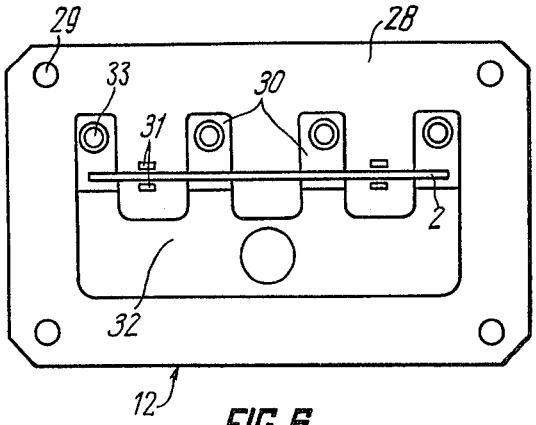
FIG. 6 shows diagrammatically the stationary plate of the casting die with a conduit in a die-casting machine.

The casting die 12 (FIG. 6) has two metallic plates 28, movable and stationary (the movable plate is not shown in the drawing).

The plate 28 is provided with guide pins 29 which are insertable into the corresponding holes in the movable plate of the casting die (not shown). Made in the plate 28 are cavities 30 whose shape corresponds to that of the connecting elements 1 of the conduit 2 (FIG. 1).

Locking means 31 used for aligning the conduit 2 are fixed on the plate 28. Also made in this plate is a gating system 32 which serves to pour molten metal into the cavities 30.

A core 33 in the casting die 12 shapes the through passage 3 (FIG. 2) in the connecting element 1.

The method and apparatus and/or device of the invention is performed and operated on in the following way.

The apparatus and/or device is arranged on a known casting machine, the conduit 2 is fed into the casting die 12 which has cavities 30 of a shape corresponding to the shape of the connecting elements 1 of the conduit being produced. The continuous-surface conduit 2 is aligned in the casting die 12 in such a way that the axis of the core 33 of the casting die 12, which produces the through passage 3 of each connecting element 1, is set off relative to the axis of the conduit 2 at a distance "A" which is sufficient to obtain a strong and tight coupling of the conduit 2 with the connecting elements 1. It is most preferable that the distance "A" by which the axis of the aforementioned elements of the conduit being produced is set off exceeds the radius "R" of the through passage 3 of the connecting element 1.

By turning the housing 9 about the bar 13 of the die-casting machine, the aforementioned apparatus and/or device is brought into the working position.

Continuous-surface conduits 2 (FIGS. 4 and 5) are loaded into the storage 14 while the housing 9 is in the uppermost position. The housing 9 is moved by means of the power cylinder 17 into the lowermost position where the storage 14 is brought through the slot 15 into connection with the cavity of the casting die 12.

Simultaneously with the rectilinear motion of the housing together with the knurling die 20, the knurling roll 21 rotates because of setting of the overruning clutch 21 by the lever 25. The conduits 2, moving between the die 20 and roll 21, undergo knurling, and the knurled portions of the conduit 2 make for improved contact of the latter with the melt.

The conduits 2 with the knurled surfaces at specified locations of coupling with connecting elements, are moved down along the inclined slot 15, heated at the same locations by the burners 18 to a temperature of 300°-500° C., and after that the splitter 19 directs the conduits into the cavity of the casting die 12. With the return stroke of the piston rod 16 of the power cylinder 17, the housing 9 is withdrawn into its uppermost position. Here, the cam 24 of the overrunning clutch 23 interacts with the lever 26, moving the roll 21 back into the initial position.

The spring 27 ensures slipping of the lever 26 in interacting of another lever 25 with the cam 24 of the overrunning clutch 23.

With the aid of the locking means 31 (FIG. 6) the conduit 2 is aligned in the casting die 12 in such a way that the axis of each core 33 is set off relative to the axis of the conduit 2 a distance "a" which is sufficient to obtain a strong and tight coupling of the connecting element 1 (FIG. 1) with the conduit 2.

It is preferable to select the distance "A" so that it exceeds the radius "R" of the through passage 3 (FIG. 2).

This value of the distance "A" is advantageous since it improves the performance of the conduit because of an enlarged surface of contact between the conduit and the connecting elements. The enlarged contact area provides tight connection of these components working under vibration load arising in operation of the engine. On the other hand, the value of the distance "A" should provide for access for a working tool adapted to make a duct 34 (See FIGS. 1,2,3) from the side of the through passage. Shaping of the connecting elements 1 is then performed by a known method with the delivery of a molten metal, e.g. aluminium, under pressure through the gating system 32 into the cavities 30 of the casting die 12. For example, such operation involves the feeding of molten metal under pressure into the casting die 12 using a molding machine (not shown). The molten metal crystallizes and form connecting elements 1 of the conduit while cooling in the casting die 12. During the crystallization of the molten metal forces are produced which act on the external surface of the conduit 2 and ensure that the connecting elements 1 are secured in a strong and tight coupling or connection to the conduit 2.

The conduit 2 (FIG. 1) with connecting elements 1, produced on the die-casting machine, is then subjected to the following operation, namely, drilling of a duct 34 (FIG. 2) required for communication of the through passage 3 with the passage of the conduit.

The conduit with the connecting elements, produced by the method according to the invention, is used with sealing rings 35 at the connecting elements 1 to prevent the latter from the leakages of the fuel being drained from the engine's fuel nozzles.

In operation of the engine, normal functioning of the fuel nozzles is provided by leading off the excess fuel through the duct 8 in the nozzle 5, the axial duct 7 in the bolt 4, and the radial ducts 6 into the passage 3, and therefrom, through the duct 34, into the passage of the conduit 2.

What is claimed is:

1. A method of producing a conduit intended for communication with a plurality of working medium sources, which conduit includes at least two connecting elements spaced apart along the length thereof and rigidly secured thereto, each of said connecting elements having a through passage intended to communicate with one working-medium source, the axis of said through passage being perpendicular to a plane passing through the axis of the conduit and said through passage communicating with the passage of the conduit, which method comprises the steps of using a continuous-surface conduit; placing said conduit on a die-casting machine furnished with a device for feeding sequentially a plurality of conduits into a casting die having cavities of a shape which corresponds to the shape of said connecting elements; aligning said continuous-surface conduit in said casting die in such a way that the axis of a core shaping said through passage of each connecting element in said casting die is set off with respect to the axis of said conduit a distance sufficient for obtaining a strong and tight coupling of said connecting element with said conduit and making for access for a working tool adapted to make a duct communicating the through passage with the conduit from the side of the former; shaping said connecting elements, by casting same in said cavities of said casting die; obtaining the coupling of said conduit with said connecting elements by means of a pressing force arising on the external surface of said conduit during the period of crystallization of the material of said connecting elements during cooling; and forming ducts or passageways between said through passages in the connecting elements and said conduit.

2. A method as set forth in claim 1, including the step of knurling said conduit at the specified locations of coupling between said conduit with said connecting elements, prior to placing said conduit into said casting die of said die casting machine.

3. A method as set forth in claim 2, including the step of heating said specified locations of coupling of said conduit with said connecting elements, prior to placing said conduit into said casting die of the die casting machine.

4. The method as set forth in claim 3, wherein said knurling and heating is effected in said device for feeding said conduit into the cavity of said casting die, including a housing with a storage for said conduits, which storage communicates with an inclined slot whose longitudinal axis is perpendicular to the longitudinal axis of a conduit and at the outlet of said inclined slot a splitter is disposed, providing for vertical reciprocating motion to the housing, knurling means made in the form of a knurling die secured in said housing and a knurling roll rotatable about an axis parallel to the longitudinal axis of the conduit, said knurling die and roll facing each other with their knurl-shaping surfaces, and a heater disposed at the lower level of the inclined slot, said knurling means and said heater being arranged in succession along the path of said conduits' motion, the number of said knurling means and said heaters corresponding to the specified number of locations of coupling between the conduit and the connecting elements.

5. The method as set forth in claim 3, wherein said specified locations of coupling between said conduit and said connecting elements are heated to a temperature of 300°–500° C.

6. The method of claim 4, wherein the knurling of said specified locations on said conduit takes place simultaneously with said feeding of said conduit into said casting die.

7. The method as set forth in claim 1, wherein said distance exceeds the radius of said through passage of said connecting element, so as to provide an enlarged surface of contact between said conduit and said connecting elements, thereby providing for strong and tight connections; and so as to provide access for a working tool to make said duct or passageway communicating the through passages of said connecting elements with the conduit from the side of the former.

8. A conduit made in accordance with the method of claim 7.

* * * * *